United States Patent [19]

Shwisha

[11] Patent Number: 4,828,505

[45] Date of Patent: May 9, 1989

[54] ELECTRICAL CONNECTION FOR TRACK LIGHTING

[75] Inventor: Haim Shwisha, Westport, Conn.

[73] Assignee: Electrix, Inc., New Haven, Conn.

[21] Appl. No.: 161,082

[22] Filed: Feb. 26, 1988

[51] Int. Cl.[4] ..... H01R 25/14

[52] U.S. Cl. ..... 439/119; 362/226; 439/121

[58] Field of Search ..... 439/207-216, 439/110-122, 668, 669; 362/226; 174/54, 61-63; 336/107

[56] References Cited

U.S. PATENT DOCUMENTS

| | | | |
|---|---|---|---|
| 2,480,843 | 9/1949 | Follmer | 439/668 |
| 3,836,937 | 9/1974 | Donato | 439/119 |
| 4,289,365 | 9/1981 | Rutgers | 439/116 |
| 4,420,216 | 12/1983 | Motoyama et al. | 439/669 |
| 4,676,567 | 6/1987 | Mouchi | 439/207 |
| 4,699,439 | 10/1987 | Cohen | 439/207 |
| 4,749,358 | 6/1988 | Soleanski | 439/119 |

FOREIGN PATENT DOCUMENTS

| | | | |
|---|---|---|---|
| 1911315 | 7/1970 | Fed. Rep. of Germany | 439/110 |
| 0109706 | 10/1964 | Netherlands | 439/110 |
| 2120024 | 11/1983 | United Kingdom | 439/116 |

*Primary Examiner*—Gary F. Paumen

*Attorney, Agent, or Firm*—Bachman & LaPointe

[57] ABSTRACT

The present invention relates to a track lighting system comprising a lighting fixture, a powered track having electrical conductors, and a two-piece device for electrically and mechanically connecting the light fixture to the powered track. The two-piece device includes a housing having contacts for engaging the track conductors, a transformer connected to the contacts, and a connection for receiving a jack-type connector to which the light fixture is electrically and mechanically connected. In a preferred embodiment, the receiving connection includes a spring member for electrically and mechanically engaging a tip portion of the jack connector and an annular wire terminal for forming part of an electrical circuit with a second conductive portion of the jack connector.

15 Claims, 2 Drawing Sheets

ELECTRICAL CONNECTION FOR TRACK LIGHTING

BACKGROUND OF THE INVENTION

The present invention relates to the field of track lighting and in particular to an electrical connector to be used in a track lighting system.

Track lighting has become quite popular as a system for lighting the interior of a room or other enclosure. A typical track lighting system includes a track with a plurality of electrical conductors mounted to a support structure such as a ceiling or a wall, one or more lighting fixtures, and a connector for mounting each fixture to the track and for placing each fixture in electrical communication with the conductors in the track. As can be seen from U.S. Pat. Nos. 4,676,567 to Moochi and U.S. Pat. No. 4,699,439 to Cohen, a number of different connectors are known and used in the art.

One of the limitations in many track lighting systems is the need to use different connectors with different lighting fixtures. Thus, if someone wants to change a lighting fixture, a new connector has to be purchased along with the new fixture. Other problems include connector installation difficulties and poor electrical and mechanical connections between the connector and the track rail, the conductors in the track, and/or the lighting fixtures.

Accordingly, it is an object of the present invention to provide an electrical and mechanical connector for a track lighting system which is simple to install and use.

It is a further object of the present invention to provide a connector as above which may be used with a wide variety of lighting fixtures and holders.

It is still a further object of the present invention to provide a connector as above which is electrically and mechanically safe in its assembled condition.

These and other objects and advantages will become more apparent the following description and drawings in which like reference numerals depict like elements.

SUMMARY OF THE INVENTION

The foregoing objects and advantages are obtained by a track lighting system comprising a longitudinally extending track having two rails defining a longitudinally extending slot and two electrical conductors extending substantially the entire length of the track, one or more lighting fixtures, and a two-part connector for electrically connecting each fixture to the conductors in the track and for mechanically connecting each fixture to the track. The electrical and mechanical connector of the present invention has a first connecting device with two opposed flanges for engaging the track rails and two electrical contacts for engaging the electrical conductors. In a preferred construction, this connecting device comprises a housing for a transformer in electrical communication with electrical contacts incorporated into the housing structure. The housing contains means for receiving a second connecting device to which the lighting fixture is electrically and mechanically connected and for electrically connecting the second device to the transformer.

The second connecting device in a preferred construction is a bayonet- or jack-type connector comprising an outer cylindrical sleeve member forming a first electrically conductive member, an inner stem member having a substantially ball-shaped tip portion forming a second electrically conductive member, and a sleeve of electrical insulating material intermediate the inner and outer members. The outer sleeve member is provided with a threaded portion for engaging a swivel type holder for the light fixture and a threaded nut for positioning the holder.

The second connecting device is joined to the first connecting device by inserting it into an opening in a surface of the housing forming the first connecting device. The substantially ball-shaped tip portion of the inner stem member is engaged by a spring-like element electrically connected to the transformer while the outer sleeve member is engaged by an annular contact element also electrically connected to the transformer. In addition to forming an electrical connection, the spring-like element mechanically holds the second connecting device in the desired position.

Still other features of the present invention will become apparent from the following description.

DETAILED DESCRIPTION

Figure 1:
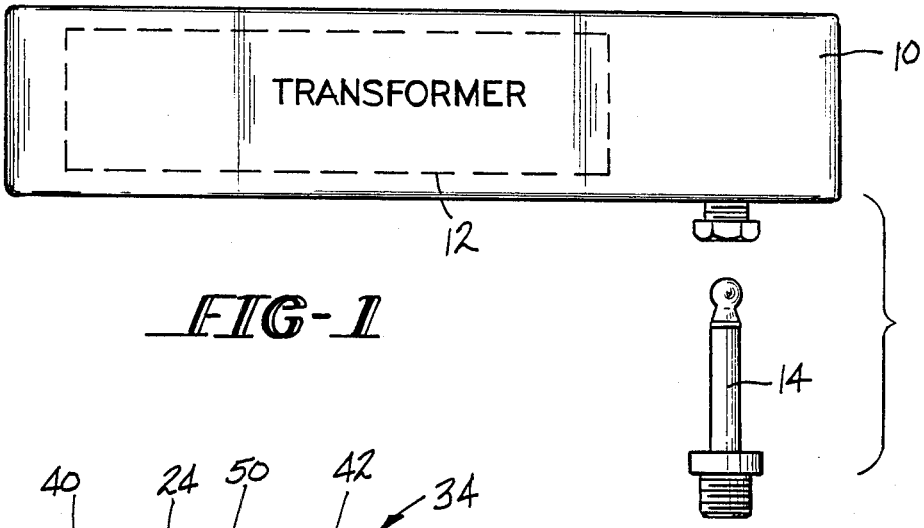
FIG. 1 is a perspective view of the electrical and mechanical connector of the present invention.

The track lighting system of the present invention utilizes a two-part connector to mechanically and electrically connect a lighting fixture to a track with two or more electrical conductors. Referring now to the drawings, the two-part connector as shown in FIG. 1 comprises a rectangularly shaped housing 10 in which a step-down transformer 12 is located and a bayonet- or jack-type connector 14 to be partially inserted into the housing 10. The transformer 12 located in the housing 10 may comprise any suitable transformer known in the art. Typically, it takes 110 V current down to 12 V current.

The housing 10 is provided with a removable cover 16 for gaining access to its interior and the components therein. Incorporated into the cover structure is a tubular member 18 extending upwardly from the cover and two integrally formed, opposed flanges 20 and 22 joined to the member 18. The flanges 20 and 22 are located on the member so as to be spaced from the surface of the cover. The housing 10, the tubular member 18 and the flanges 20 and 22 are preferably made of an electrically non-conductive material such as plastic. Contact members 24 and 26 are made of an electrically conductive material and extend through a channel 27 in the member 18 from the interior of the housing 10 to a point beyond the tubular member. The contact members 24 and 26 are electrically connected to the transformer 12 by suitable means such as wires 30 and 32.

Figure 2:
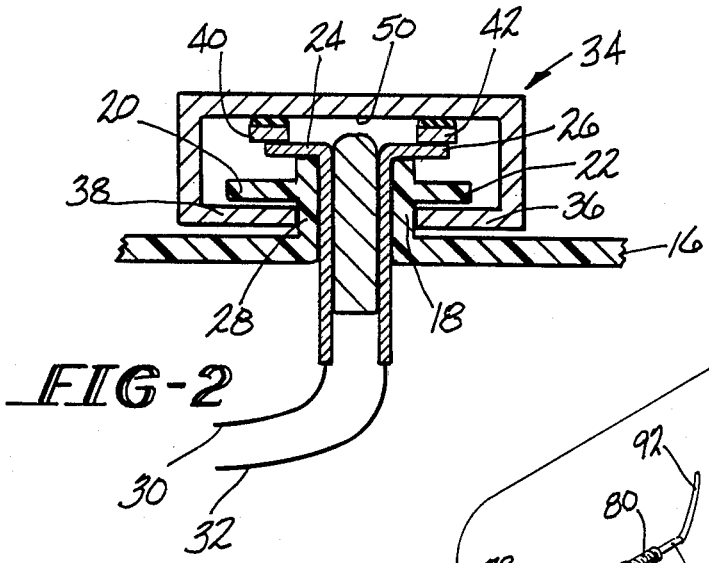
FIG. 2 is a cross sectional view of a track used in the track lighting system and a first connecting device connected thereto.

As shown in FIG. 2, the track lighting system includes a longitudinally extending track 34 having two rails 36 and 38 defining a longitudinally extending slot 28. The track 34 may be made from any suitable metal or non-metal material. Two electrical conductors 42 and 44 are positioned within the track for providing electrical service. When the track is formed from a metallic material, suitable electrical insulating material is positioned intermediate the conductors and the track. The track 34 may be joined to any desired support structure such as a wall or a ceiling using any suitable fastening means known in the art.

Figure 6:
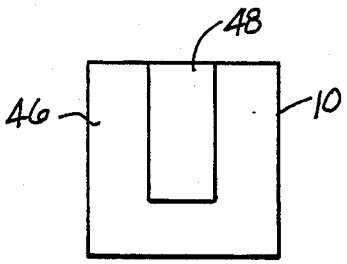
FIG. 6 shows an end view of a first connecting device.

The housing 10 is joined to the track 34 by inserting the member 18 into the slot 28 and rotating the housing 10 until the rails 36 and 38 are positioned intermediate the flanges 20 and 22 and the top of the cover 16. When locked in this position, the contacts 24 and 26 are in electrical engagement with the conductors 42 and 44 in the track. To assist in correctly positioning the housing 10 and maintaining the flanges 20 and 22 and the contacts 20 and 24 in engagement with the rails 36 and 38 and the conductors 42 and 44 respectively, an end wall 46 of the housing as shown in FIG. 6 is provided with a spring loaded plate member 48 which fits into the slot 28 and engages a portion 50 of the track opposed to the slot 28. Suitable means such as a tab may be provided for actuating the spring-loaded member from a retracted position to an operating position.

Figure 3:
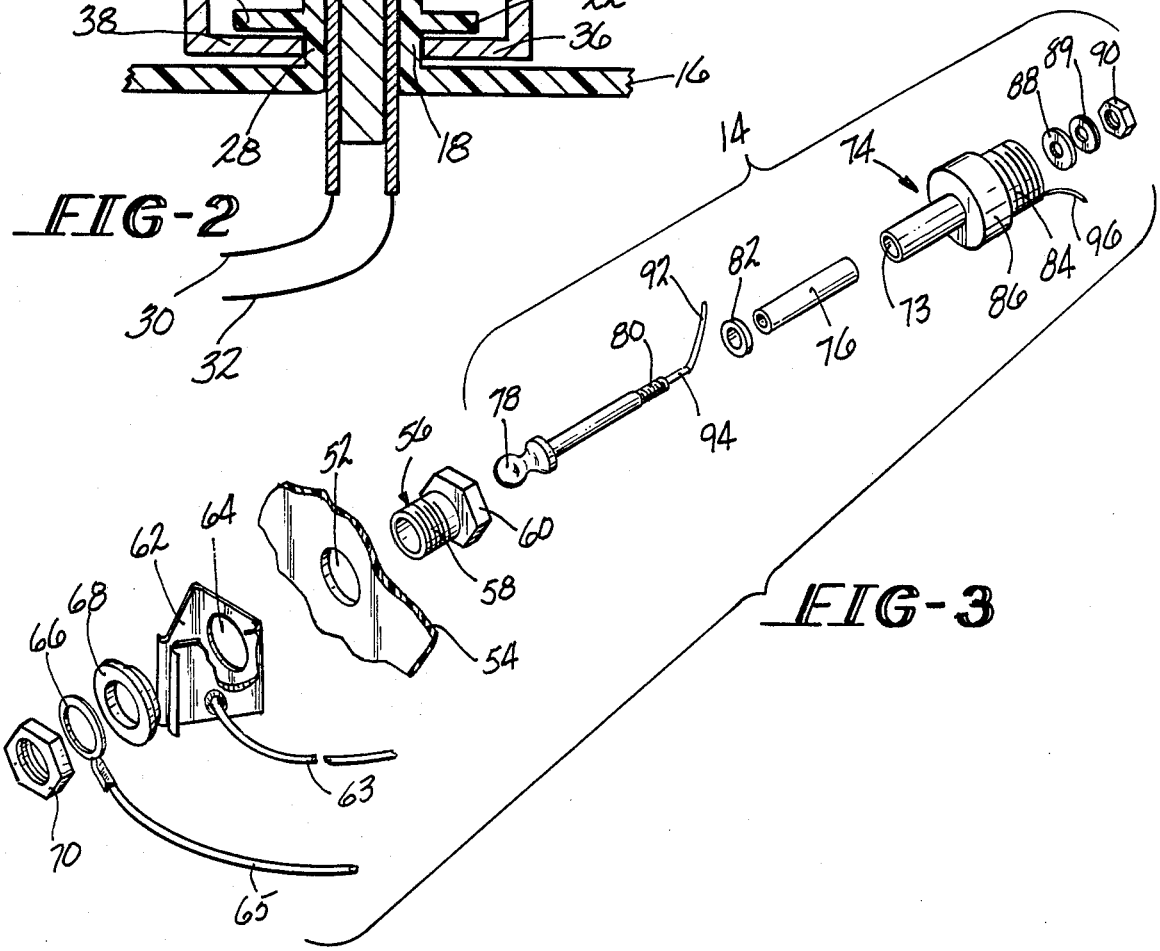
FIG. 3 is an exploded view of a second connecting device used in the connector of the present invention and the means for receiving it in the first connecting device.
Figure 7:
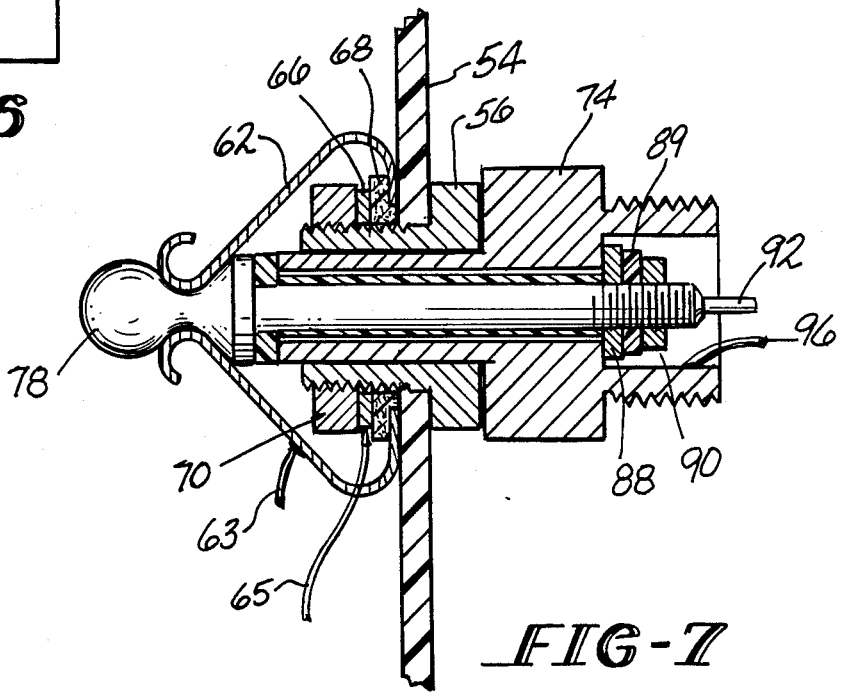
FIG. 7 illustrates a view in partial cross section of the first and second connector devices joined together.

The housing 10 is further characterized by a means for receiving the bayonet-type or jack-type connector 14. The receiving means as shown in FIG. 3 and 7 includes an opening 52 in a surface 54 and a nipple 56, formed from an electrically conductive material, inserted into the opening. The nipple 56 has a threaded portion 58 which extends into the housing and a flange portion 60, which is preferably hex-shaped, for positioning the nipple 56 against the surface 54. The nipple 56 also has a central bore 57 into which a portion of the second connector 14 may be inserted.

The receiving means further includes a spring member 62 formed from an electrically conductive material and electrically connected to the transformer 12 by suitable means such as a wire 63. The spring member 62 is provided with an aperture 64 for receiving the threaded portion 58 of the nipple and an electrical insulator 68. The insulator 68, preferably a fiber shoulder washer, electrically isolates the spring member 62 from the nipple 56.

An annular electric contact or wire terminal 66 is provided to electrically engage the outer cylindrical sleeve member 74 of the second connector 14 via the electrically conductive nipple 56. The contact 66 is connected to the transformer 12 by suitable means such as a wire 65. The contact 66 is electrically isolated from the spring member 62 by the fiber shoulder washer 68. A hex nut 70 is provided to hold the spring member 62, the washer 68 and the contact 66 in position. The nut 70 accomplishes this by threadably engaging the threaded portion 58 of the nipple 56.

The connector 14 as shown in FIG. 3 comprises a stem member 72 formed from an electrically conductive material, a substantially cylindrical outer sleeve member 74 also formed from an electrically conductive material, and a cylindrical member or sleeve 76 formed from an electrical insulating material intermediate the stem member 72 and the sleeve member 74. As can be seen from FIG. 3, the sleeve member 74 has a bore 73 for receiving the stem member 72. The bore 73 extends the entire length of the sleeve member 74 and has a first diameter in the portion adjacent the tip portion 78 of the stem and a second, larger diameter at a second opposed end. The sleeve member 74 at the second end is further characterized by an exterior threaded portion 84 and a flange portion 86. The stem member is provided with a substantially ball-shaped tip portion 78 and a threaded portion 80 adjacent the opposite end 94. A fiber washer 82 is provided about the stem member 72 to electrically insulate the tip portion 78 from the sleeve member 74.

To secure the stem member to the sleeve member, the stem member 72 is inserted into the sleeve member 74 until the threaded portion 80 extends into the bore in the threaded portion of the sleeve member. Thereafter, a fiber washer 88 and a steel washer 89 are placed about the threaded portion 80 and a nut 90 is screwed onto the threaded portion 80. To provide electrical service for a lighting fixture mounted to the connector 14, a first connector 92 such as a first wire is joined to the end 94 of the stem member extending beyond the nut 90 and a second connector 96 such as a second wire is joined to the threaded portion 84 of the member 74, preferably the interior of the threaded portion.

As shown in FIG. 7, the connector 14 is inserted into the receiving means of the housing 10. When properly seated, the tip portion 78 of the stem member is electrically and mechanically engaged by the spring member 62 while the outer sleeve member 74 is in electrical communication with the wire terminal 66 via the nipple 56.

Figure 4:
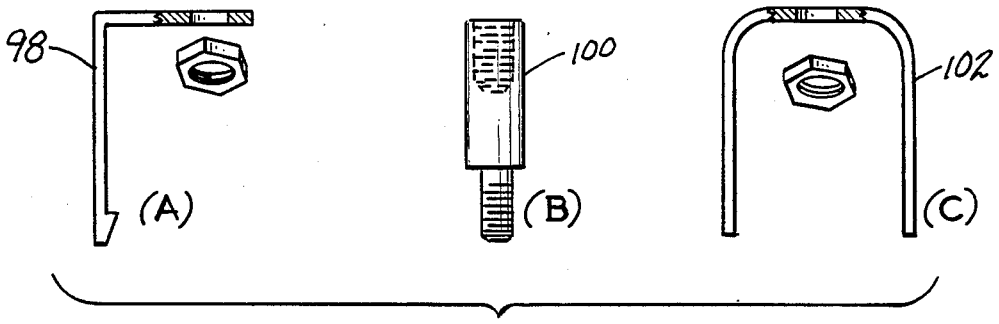
FIG. 4 illustrates a number of swivel-type holders which may be mounted to the second connecting device.
Figure 5:
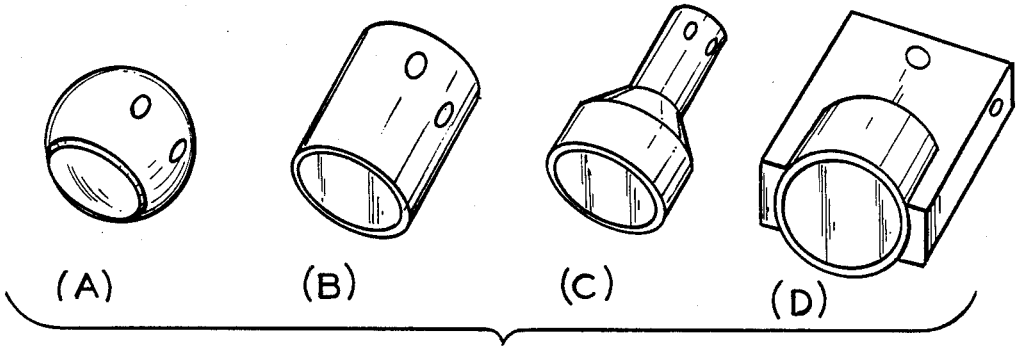
FIG. 5 illustrates a number of lighting fixtures which may be used in the track lighting system of the present invention.

As shown in FIG. 4, a number of different holders for supporting a lighting fixture may be joined to the threaded portion 84 of the sleeve member. For example, a L-shaped swivel member 98 or horseshoe member 102 may be connected to the threaded portion 84 using a washer and nut. Alternatively, a mechanical type of swivel connector 100 may be threaded onto the portion 84. The ability to use the connector of the present invention with many different types of holders is quite desirable because it provides great flexibility to the track lighting system. One need only look at the different types of lighting fixtures shown in FIG. 5 to realize the benefits of the present invention. Each of the illustrated lighting fixtures may be mechanically joined to any of the illustrated holders and electrically connected to the appropriate connections provided by the connector 14.

It should of course be realized that the track lighting system of the present invention may have several lighting fixtures, each connected to the conductors in the track by its own two-part mechanical and electrical connector.

It should further be realized that an electrical appliance other than a light fixture may be coupled to the conductors in a track using the connector of the present invention.

As can be seen from the foregoing description, the connector of the present invention is simple to install and use. Additionally, the connector is electrically and mechanically safe in its assembled condition.

While the housing 10 has been shown as having a rectangular shape, it could have any desired shape.

It is apparent that there has been provided in accordance with this invention an electrical connection for track lighting which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A track lighting system comprising:

a lighting fixture;

a longitudinally extending track having two rails defining a longitudinally extending slot and two electrical conductors substantially extending the length of said track;

means for electrically connecting said light fixture to said conductors in said track and for mechanically connecting said lighting fixture to said track;

said connecting means comprising a first connecting device which includes a housing having a transformer located therein, means for engaging the track rails and means for engaging said electrical conductors;

said electrical conductor engaging means being electrically connected to said transformer;

said connecting means further comprising a second connecting device for securing said light fixture to said first connecting device and for establishing an electrical connection between said lighting fixture and said means for engaging said electrical conductors associated with said first connecting device; and said first connecting device further including means for receiving said second connecting device.

2. A track lighting system as set forth in claim 1 wherein said second connecting device comprises a jack-type connector having a first electrically conductive member for forming part of an electrical circuit and a second electrically conductive member electrically insulated from the first conductive member for forming another part of said electrical circuit.

3. A track lighting system as set forth in claim 2 wherein:

said first electrically conductive member comprises a sleeve member formed from an electrically conductive material;

said second electrically conductive member comprises a stem member formed from an electrically conductive material and sized to fit within a bore in said sleeve member; and said second connecting device further includes a tubular member formed from an electrically non-conductive material, said tubular member being positioned within said bore intermediate said electrically conductive members.

4. A track lighting system as in claim 3 further comprising means connected to said electrically conductive members for providing electrical service to said lighting fixture.

5. A track lighting system as in claim 3 wherein said second connecting device receiving means comprises:

an aperture in a first portion of said housing;

a nipple having a bore for receiving a portion of said second connecting device inserted into said aperture; and a spring member for mechanically and electrically engaging a tip portion of said second connecting device.

6. A track lighting system as in claim 5 wherein said nipple is formed from an electrically conductive material;

said receiving means further comprises an annular electrical contact which electrically communicates with said first electrically conductive member via said nipple; and said spring member engages a substantially ball-shaped tip portion of said second electrically conductive member.

7. A track lighting system as in claim 6 wherein said receiving means further comprises:

said nipple having a threaded portion;

said spring member having an aperture for permitting said spring member to be mounted on said threaded nipple portion;

a washer formed from an electrically non-conductive material placed intermediate said spring member and said annular contact;

said washer electrically isolating said spring member from said nipple; and nut means for engaging said threaded nipple portion, said nut means holding said spring member, said washer and said annular contact in position.

8. A track lighting system as set forth in claim 7 wherein said housing is formed from an electrically non-conductive material and said receiving means aperture comprises an opening in a wall of said housing.

9. A track lighting system as set forth in claim 8 wherein said first connecting device further includes two electrical contacts forming said electrical conductor engaging means, and means for electrically connecting said transformer to said electrical contacts which engage said electrical conductors in the track and to said spring member and said annular electric contact forming part of said receiving means.

10. A track lighting system as set forth in claim 8 wherein said housing has a removable cover and said track rail engaging means comprises a tubular member attached to said cover and two opposed flanges attached to said tubular member and spaced from a surface of said cover, whereby each said rail is accommodated within the space between one of said flanges and said cover surface.

11. A track lighting system as in claim 1 further comprising:

a plurality of said lighting fixtures; and a plurality of said first and second connecting devices for mounting and electrically connecting said fixtures to said track.

12. An electrical connecting device for connecting an electrical appliance to an electrical power track, which comprises:

a housing made of an electrically non-conductive material;

said housing including electrical contacts and means for placing said contacts in electrical contact with electrical conductors in said track; and said housing further including means for receiving a jack-type connector to which said electrical appliance is electrically and mechanically connected and means for electrically connecting said contacts to said receiving means including a transformer within said housing.

13. A device as in claim 12 wherein said receiving means includes a spring-like electrical contact for electrically and mechanically engaging a tip portion of said jack-type connector.

14. A device as in claim 13 wherein:

said jack-type connector comprises a first electrically conductive member formed by a sleeve member made of an electrically conductive material and having a central bore, a second electrically conductive member formed by a stem member made of an electrically conductive material, and means for electrically insulating said conductive members;

said spring-like electric contact engages a substantially ball-shaped portion of said stem member; and said receiving means further includes an annular terminal for electrically engaging said sleeve member.

15. A track lighting system comprising:

a lighting fixture;

a longitudinally extending track having two rails defining a longitudinally extending slot and two electrical conductors substantially extending the length of said track;

means for electrically connecting said light fixture to said conductors in said track and for mechanically connecting said lighting fixture to said track;

said connecting means comprising a first connecting device having means for engaging the track rails and means for engaging said electrical conductors;

said connecting means further comprising a second connecting device for securing said light fixture to said first connecting device and for establishing an electrical connection between said lighting fixture and said means for engaging said electrical conductors associated with said first connecting device;

said first conencting device having means for receiving said second connecting device;

said second connecting device comprising a jack-type connecting having a first electrically conductive member for forming part of an electrical circuit and a second electrically conductive member electrically insulated from the first conductive member for forming another part of said electrical circuit;

said first electrically conductive member comprising a sleeve member formed from an electrically conductive material;

said second electrically conductive member comprising a stem member formed from an electrically conductive material and sized to fit within a bore in said sleeve member;

said second connecting device further including a tubular member formed from an electrically nonconductive material, said tubular member being positioned within said bore intermediate said electrically conductive members;

means for holding said light fixture; and a threaded portion on said sleeve member for engaging said holding means.

* * * * *